United States Patent [19]

Kostylev et al.

[11] 3,941,101

[45] Mar. 2, 1976

[54] IMPACT ACTION MECHANISM

[76] Inventors: Alexandr Dmitrievich Kostylev, ulitsa Derzhavina, 19, kv. 44; Konstantin Stepanovich Gurkov, ulitsa Derzhavina, 18, kv. 13; Konstantin Konstantinovich Tupitsyn, ulitsa Krylova, 3, kv. 37; Vladimir Isaakovich Kreimer, ulitsa Voskhod 7, kv. 73, all of Novosibirsk, U.S.S.R.

[22] Filed: Dec. 28, 1973

[21] Appl. No.: 429,369

[52] U.S. Cl. ..... 123/46 H; 175/19; 173/134

[51] Int. Cl.[2] ..... F02B 71/00

[58] Field of Search ..... 175/19; 173/134; 123/46 A, 123/46 R, 46 H

[56] References Cited

FOREIGN PATENTS OR APPLICATIONS

| | | | |
|---|---|---|---|
| 870,080 | 3/1953 | Germany | 173/134 |
| 1,220,952 | 5/1960 | France | 175/19 |
| 1,196,607 | 7/1965 | Germany | 173/134 |

*Primary Examiner*—Charles J. Myhre
*Assistant Examiner*—William C. Anderson
*Attorney, Agent, or Firm*—Holman & Stern

[57] ABSTRACT

An impact action mechanism of the type wherein the impact member is propelled by a combustible matter combusted in the combustion chamber of the mechanism. The impact action mechanism includes a hollow housing receiving therein a reciprocating impact member and a sleeve connected with the housing. The impact member has a tail portion receivable in the sleeve to define therewith, as the impact member moves into the sleeve, a closed combustion chamber. This combustion chamber communicates with the ambient atmosphere for exhaust of the combustion products and with a source of a combustible matter, respectively, through a pair of passages formed through the bottom of the sleeve. The impact action mechanism is small in size in the transverse section and offers a simple structure, which permits its utilization in the mining and construction industries, as well as for driving through holes in soil.

4 Claims, 4 Drawing Figures

IMPACT ACTION MECHANISM

BACKGROUND OF THE INVENTION

The present invention relates to impact action devices utilized in the mining and construction industries for breaking rock and other materials, for ramming and tamping purposes, for driving in pins and nails, for driving through holes in soil, etc. and, more particularly, it relates to an impact action device wherein the impact member is propelled by the combustion of a combustible matter in the combustion chamber of the device.

At present, an impact action device is known having a housing which receives therein a sleeve and an impact member mounted for reciprocation of the housing and having an enlarged front portion and a tail portion.

The enlarged front portion of the impact member defines with the housing a buffer chamber, while the tail portion of the impact member, when introduced into the sleeve, defines therewith a combustion chamber within the sleeve. This lastmentioned chamber periodically communicates with a source of combustible matter to propel the impact member through a working stroke, as well as with the ambient atmosphere to exhaust the products of combustion.

However, this known impact action device is of a relatively complicated structure and includes a relatively great number of components of different weights, movable relative to one another, which results in rapid wear of these components. Thus, the known device includes an ignition means mounted on the housing thereof and associated with a source of power supply to produce a spark for igniting the combustible mixture in the combustion chamber. The source of power supply circuit is periodically closed by one of the movable components mounted on the impact member.

The ignition device is expected to meet relatively strict requirements, as to reliability and accuracy. However, it is rather difficult to meet these requirements in a device operating in an impact mode. The natural wear of the movable components of the ignition means is aggravated by the wear brought about by great dynamic loads caused by this impact mode of operation. This leads to a short life for the ignition means, to delayed timing of production of a spark and to faulty operation of the impact device, as a whole.

To start the operation of the impact action device of known design, it is necessary to employ an auxiliary mechanism to effect an initial stroke of the impact member, sufficient for compression and ignition of the cobmustible matter in the combustion chamber. More often than not, such an auxiliary starting mechanism is mounted directly on the housing of the impact mechanism.

In the hitherto known impact action devices the exhaust opening for the products of combustion is situated either in the lateral surface of the mechanism, or else in the front face thereof.

Furthermore, the arrangement of the ignition and starting devices directly on the housing of the impact device results in a considerable increase in the transverse dimensions of the device, as a whole, while the arrangement of the exhaust opening in the lateral surface of the impact device and in the front face thereof prohibits the use of the device for driving through holes in soil.

At present, compressed pneumatic impact action devices for driving through holes in the soil, are also known which are, however, incapable of self-sustained operation, since they need an air compressor and means for carrying this air compressor to the site of operation.

SUMMARY OF THE INVENTION

It is an object of the present invention to provide an impact action device wherein the combustion chamber is so connected with a source of supply of combustible matter so that the device requires no auxiliary means mounted on the external surface thereof, with simultaneous reduction of the overall dimensions of the device, including the transverse dimension, the mechanism being capable of driving through holes in soil.

These and other objects are attained in an impact action device comprising a hollow housing receiving therein a sleeve and a reciprocating impact member having an enlarged front portion defining with the front portion of the housing a buffer chamber to effect a return stroke of the impact member. The impact member has a tail portion defining with the housing an annular gap and adapted to be received in the sleeve to define therewith a closed combustion chamber, as the impact member moves into the sleeve during operation of the device. This combustion chamber periodically communicates with a source of supply of combustible matter to propel the impact member through a working stroke by combustion of the combustible matter, the combustion chamber also periodically communicating with the ambient atmosphere to exhaust the products of combustion, in which impact device, in accordance with the present invention, the sleeve is coupled with the housing so that the bottom of the sleeve defines the end face of the housing and has two passages formed in the end face, one of these passages communicating with the source of supply of the combustible matter, while the other passage communicates with the ambient atmosphere, the passages communicate with the combustion chamber through grooves made in the lateral surface of the sleeve and merge with two respective ports which are periodically closed by the tail portion of the impact member during the return stroke thereof, to disconnect the passages from the combustion chamber.

With the sleeve and the housing being operatively associated in the herein disclosed manner and with the made passages made in the bottom of the sleeve and opening in the end face of the housing, the passages communicating with the combustion chamber, it is possible to effect the supply of the combustible matter and to exhaust the combustion gases at the rear end face of the mechanism and thus to have no additional means mounted on the housing of the apparatus and, consequently, to reduce the transverse dimensions of the impact action device.

Furthermore, the herein disclosed manner of communication of the combustion chamber with the ambient atmosphere and with the source of the combustible matter, i.e. of the combustion fuel, provides an extremely simple structure and has enabled the apparatus to be employed for driving through holes in the soil.

The invention is further characterized in that the port of the sleeve, communicating through the respective passage with the source of the fuel, is of a smaller size and is more remote from the bottom of the sleeve than the other port communicating through the other passage with the ambient atmosphere.

The two ports being of different sizes and the smaller of them communicating with the source of fuel supply, it is ensured that the exhaust gases are exhausted through the larger port before the fuel is introduced into the combustion chamber, which provides optimal conditions for normal operation of the impact action device of the invention.

The invention is still further characterized in that the sleeve has a longitudinal slot formed therein for establishing communication between the abovementioned annular gap and the source of fuel supply. The sleeve further having formed therein blind notches for communicating with the annular gap, the bottom of each notch being aligned with that one of the edges of the smaller port, which is the least remote from the bottom of the sleeve.

The provision of the blind notches in the sleeve, establishing communication between the annular gap and the combustion chamber, ensures that the fuel is additionally charged from the annular gap into the combustion chamber during a working stroke of the impact member, which improves the conditions of filling of the combustion chamber with the fuel.

The invention is still further characterized in that the a longitudinal groove housing has, defining an annular gap, in which the longitudinal groove is of a length which is greater than the length of the enlarged portion of the impact member for establishing periodical communication between the buffer chamber and the annular gap during a return stroke of the impact member.

Last-described feature restores the pressure within the buffer chamber, which yields a prolonged operational life of the impact action device of the invention.

Thus, the abovedisclosed novel features of the impact action device provide for its extreme simplicity of its structure, compact size, reliability of performance, as well as for adaptability for a variety of applications, e.g. for driving through holes in soil, for incorporation in either hand-held or suspension mechanisms for breaking rock and other materials, for driving pins, nails, etc.

BRIEF DESCRIPTION OF THE DRAWINGS

The invention will be further described in connection with an embodiment thereof in an impact action device utilized for driving through holes in the soil, with reference being had to the accompanying drawings, wherein.

DETAILED DESCRIPTION OF PREFERRED EMBODIMENTS

Referring now in particular to the appended drawings, the impact action device according to the invention for driving holes through the soil includes a hollow cylindrical housing 1 (FIG. 1) having a pointed front portion. The internal space of the housing accommodates an impact member 2 mounted for reciprocation in the housing through working and return strokes, as well as a sleeve 3 connected with the rear portion of the housing 1. The front portion of the housing preferably has an opening made therethrough, accommodating therein a pointed striker pin 4 assisting in driving of a hole.

Figures 1, 2, 3:
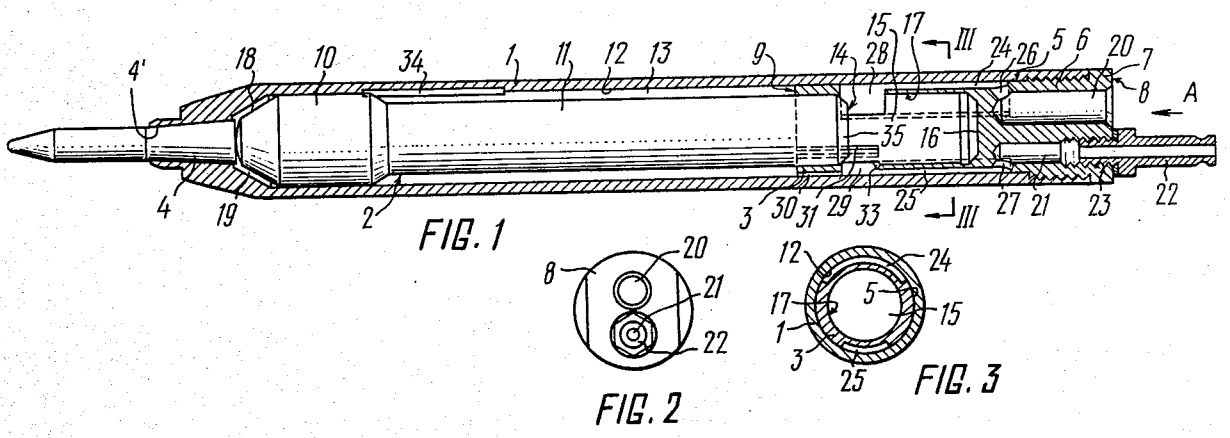
FIG. 1 is a longitudinally sectional general view of an impact action mechanism embodying the invention.
FIG. 2 is a view taken along arrow "A" in FIG. 1.
FIG. 3 is a sectional view along line III—III in FIG. 1.

The rear portion of the housing 1 has a thread cut therein, adjoining the internal space of the housing, for connection of the housing 1 with the sleeve 3, the latter having a thread cut in the external surface 5 thereof, matching the above mentioned thread in the housing, the thread being at the level of the bottom 6 of the sleeve 3. The latter has also projections 7 made on the external surface thereof, which limit screwing of the sleeve 3 into the housing 1. When the sleeve 3 is screwed into the housing 1, the external face 8 (FIG. 2) of the bottom 6 of the sleeve 3 defines the end face of the housing 1, while the face 9 of the sleeve 3, opposite to the bottom 6 thereof, is accommodated within the housing, as can be seen in FIG. 1.

The impact member 2 has an enlarged front portion 10 and a tail portion 11 the diameter of which is smaller than that of the enlarged portion 10. An annular gap 13 is thus formed between the tail portion 11 of the impact member 2 and the internal wall 12 of the housing, thus defining the internal space thereof.

The tail portion 11 has its end face 14 received in the internal space 15 (FIG. 3) of the sleeve 3, the latter having its end 9 open. When the impact member 2 reciprocates during operation of the impact device, the tail portion 11 (FIG. 1) reciprocates within the internal space 15 of the sleeve. As the impact member 2 moves into the sleeve 3, a combustion chamber if formed in the internal space 15 for combustion of a combustible matter, i.e. of a fuel, to propel the impact member 2 through a working stroke. This combustion chamber is defined by the end face 14 of the tail portion 11, the internal face 16 of the bottom 6, facing the end 9, and the internal lateral surface 17 of the sleeve 3.

The enlarged portion 10 of the impact member 2 has an external diameter matching the diameter of the internal space of the housing 1, the front portion of the enlarged portion 10 including a tapered portion 18 defining with the complementary portion of the internal surface of the front part of the housing 1 a buffer chamber 19 wherein gases are compressed during a working stroke of the impact member 2, whereby a sufficient amount of energy is stored to effect a return stroke of the impact member.

The bottom 6 of the sleeve 3 is sufficiently thick and has a pair of passages 20 and 21, the passage 20 opening in the external side 8 of the bottom 6 of the sleeve 3, i.e. in the end face of the housing 1, to communicate with the ambient atmosphere and provide for exhaust of the products of combustion, while the passage 21 is adapted to be connected via a connection 22 to a source of fuel (not shown), this source being in the form of a compressed gas container or in any other suitable form. The connection 22 is secured in the sleeve 3 by means of a threaded connection 23 including threads cut, respectively, in the external surface of the connection 22 and in the wall of the passage 21.

The passages 20 and 21 communicate with the combustion chamber, respectively, through grooves 24 and 25 (FIGS. 1 and 3) in the external lateral surface 5 of the sleeve 3, inclined passages 26 and 27 (FIG. 1) in the bottom 6 of the sleeve 3 and ports 28 and 29, respectively, provided in the sleeve, the respective grooves 24 and 25 merging with these ports. The grooves 24 and 25 define respective passages with the internal surface 12 of the housing 1.

As the impact member 2 reciprocates in the sleeve 3, the ports 28 and 29 are periodically closed off by the tail portion 11 of this impact member, whereby the passages 20 and 21 are disconnected from the combustion chamber during combustion of the fuel therein. The port 29 adapted for communication with the passage 21 and, consequently, with the fuel supply source is of a smaller size than the other port 28 and is more remote from the surface 16 of the bottom 6.

Figure 4:
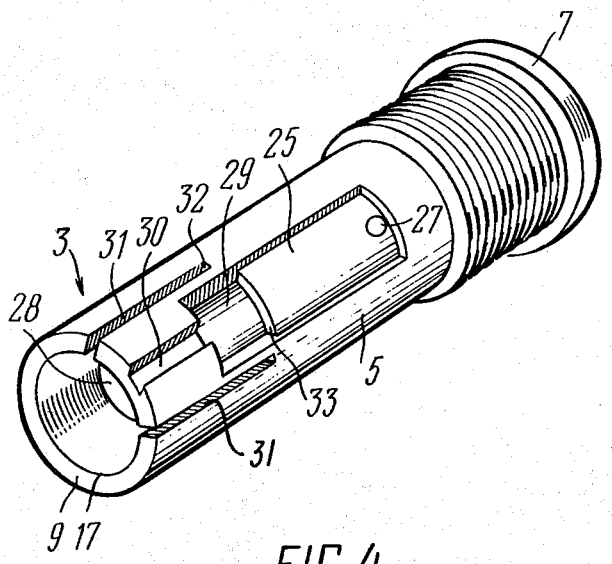
FIG. 4 is an enlarged perspective view of the sleeve of the mechanism, with the smaller port foremost.

The external lateral surface 5 of the sleeve 3 has a slot 30 (FIG. 4) defining a passage with the internal surface 12 (FIG. 1) of the housing 1, and communicating with the port 29 and open in the end face 9 of the sleeve 3, to establish communication between the annular gap 13 and the fuel supply source or ambient atmosphere.

The same portion of the sleeve 3 has cut therein blind notches 31 (FIG. 4) open in the end face 9 of the sleeve, to establish communication between the annular gap 13 and the internal space 15 of the sleeve 3. The respective bottom 32 of each notch 31 is aligned with that edge 33 of the port 29, which is the least remote from the surface 16 of the bottom 6 of the sleeve 3. This last-mentioned edge 33 of the port 29 is rounded on the side adjacent to the internal surface 15 of the sleeve 3, to improve the conditions of access of the fuel into the space 15.

The surface 12 (FIG. 1) of the housing 1 is provided with a longitudinal groove 34 opening in the annular gap 13 and having a length in excess of the enlarged portion 10 of the impact member 2, to establish periodical communication between the buffer chamber 19 and the annular gap 13, during a return stroke of the impact member 2.

The herein disclosed impact action mechanism operates, as follows.

The impact member 2 is shown in FIG. 1 in its extreme forward position, i.e. in a position where it delivers an impact upon the pin 4 and then starts its return stroke. This return stroke of the impact member 2 is effected by the action of the gas compressed in the buffer chamber 19.

As the impact member 2 moves to the right, i.e. into the space 15 of the sleeve 3, the tail portion 11 closes off the ports 28 and 29, whereby a combustion chamber is formed in the space 15 by a portion of this space isolated from the ambient atmosphere. As the impact member 2 moves further to the right, the combustible mixture that has filled the combustion chamber is compressed, whereby it is heated up and finally ignites. The combustion greatly increases the volume of the gases in the combustion chamber, and the pressure of these gases is applied to the tail portion 11 of the impact member 2, whereby the latter is propelled to the left, i.e. through a working stroke.

Since the ports 28 and 29 are of different size and offset relative to each other, during the working stroke of the impact member 2 the port 28 first becomes open and then the port 29. The products of combustion enter ambient atmosphere via the port 28, the groove 24, the inclined passage 26 and the passage 20; while the fuel flows into the space 15 of the sleeve 3 from the connection 22 via the passage 21, the inclined passage 27, the groove 25 and the port 29.

At the end of its working stroke the impact member 2 delivers an impact upon the pin 4, compresses the gas in the buffer chamber 19, whereafter, the above described operating cycle repeats itself. The buffer chamber 19 either communicates with the ambient atmosphere via the longitudinal slot 34, the annular gap 13, the slot 30, the groove 24, the inclined passage 26 and the passage 20, or else it communicates via the groove 25, the inclined passage 27 and the passage 21 with the source of fuel supply, which is necessary to restore the pressure within this chamber 19.

Additional charging of the fuel into the internal space 15 of the sleeve 3 is effected through the blind notches 31 in the sleeve 3 during the working stroke of the impact member 2. This increases the concentration of the fuel in the space 15 of the sleeve 3 and thus intensifies the operation of the impact action mechanism.

Starting of the operation of the herein disclosed impact action mechanism is effected, as follows.

The impact member is moved toward its extreme L.H. (forward) position, which is performed by mere raising of the right-hand end of the mechanism above the left-hand one. To speed up the motion of the impact member 2 to the left, it is sufficient to remove (i.e. to strike out) the pin 4 from the forward opening 4′ in the housing, which establishes communication betwen the buffer chamber 19 and the ambient atmosphere through this last-mentioned opening. Then the space 15 of the sleeve 3 is flushed with the combustible matter, e.g. with the help of a charging device (not shown in the drawing), the combustible matter being directed into the space 15 by the rounded edges 33 of the port 29 and by a bevel 35 cut in the end face 14 of the tail portion 11 of the impact member 2. Thereafter the impact member 2 is moved into its intermediate position, whereat, the ports 28 and 29 become closed, and a pressure approximating the atmospheric pressure is established at both sides of the impact member 2. Thereafter the pin 4 is reestablished in the corresponding opening of the housing 1.

By jerking the mechanism longitudinally, or else by striking the housing thereof correspondingly the impact member moves into its R.H. position to provide an amount of energy sufficient to compress and ignite the combustible matter in the combustion chamber.

Although the present invention has been described in connection with an embodiment thereof adapted for driving holes through soil, the herein disclosed mechanism may be successfully used for other purposes for which it is adapted by mere replacement of the pin 4 with a corresponding work-performing member.

What is claimed is:

1. An impact action device comprising: a hollow housing; a sleeve having an internally provided space open at one end and a thickened bottom portion, said sleeve having an external lateral surface and being accommodated in an internal space of said housing and operatively coupled to said housing so that the bottom portion of said sleeve defines the end face of said housing; an impact member reciprocably movable through working strokes and return strokes and having an enlarged front portion and a tail portion, mounted in the internal space of said housing so that said enlarged front portion thereof defines with the front part of said housing a buffer chamber for driving said impact member through said return strokes, while said tail portion of said impact member defines with said housing an annular gap and is receivable in the space of said sleeve; a closed combustion chamber defined in said sleeve by additional introduction of the tail portion of said impact member into the internal space of said sleeve; a first passageway formed in the bottom portion of said sleeve and communicating with said combustion chamber, said passageway being open in the end face of said housing for supply of a combustible matter into said combustion chamber to propel said impact member through the working strokes thereof by combustion of said combustible matter; a second passageway formed in the bottom portion of said sleeve and communicating with said combustion chamber, said second passageway being open in the end face of said housing for communication with ambient atmosphere, to provide for exhaust of the products of combustion from said combustion chamber; a plurality of ports provided in said sleeve and communicating with the internal space thereof, said ports being periodically closed off by said tail portion of said impact member during return strokes thereof; a plurality of grooves formed in the external lateral surface of said sleeve and registering with respective ones of said plurality of ports at one end of said grooves, said groves communicating at the respective opposite ends thereof with the respective ones of said first and second passageways, to establish communication of said first and second passageways with said combustion chamber, respectively, to supply said combustible matter thereinto and to exhaust said combustion products therefrom whereby the periodical closing off by said tail portion of said ports separates said combustion chamber from said first and second passageways, during combustion of said combustible matter therein to effect working strokes of said impact member and subsequent exhaust of said combustion products.

2. An impact action mechanism, as claimed in claim 1, wherein that one of said ports in said sleeve, communicating with the source of supply of a combustible matter through a respective one of said passageways is of a smaller size and is more remote from the bottom of said sleeve than the other one of said ports communicating with the ambient atmosphere through the other respective one of said passageways.

3. An impact action mechanism as claimed in claim 2, wherein said sleeve has a longitudinal slot establishing communication between an annular gap and the source of supply of a combustible matter, and blind notches communicating with said annular gap, the bottom of each said notch being aligned with that one of the edges of the smaller one of said ports, which is the least remote from the bottom of said sleeve.

4. An impact action mechanism as claimed in claim 3, wherein the surface of said housing, defining said annular gap, has a longitudinal slot, the length of which is in excess of the length of the enlarged portion of said impact member, for establishing periodic communication between said buffer chamber and said annular gap during return strokes of said impact member.

* * * * *